US010328596B2

(12) United States Patent
Klockow

(10) Patent No.: US 10,328,596 B2
(45) Date of Patent: Jun. 25, 2019

(54) STRIPPER PLATES, DICING MACHINES THAT UTILIZE STRIPPER PLATES, AND METHODS OF USE

(71) Applicant: URSCHEL LABORATORIES, INC., Chesterton, IN (US)

(72) Inventor: Scott Alan Klockow, Kouts, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 337 days.

(21) Appl. No.: 14/959,016

(22) Filed: Dec. 4, 2015

(65) Prior Publication Data

US 2017/0157788 A1 Jun. 8, 2017

(51) Int. Cl.

| | |
|---|---|
| ***B26D 3/22*** | (2006.01) |
| ***B26D 7/18*** | (2006.01) |
| ***B26D 1/38*** | (2006.01) |
| ***B26D 3/18*** | (2006.01) |
| ***B26D 7/06*** | (2006.01) |

(52) U.S. Cl.

CPC ..... *B26D 7/1845* (2013.01); *B26D 1/38* (2013.01); *B26D 3/18* (2013.01); *B26D 7/0691* (2013.01); *B26D 7/1818* (2013.01); *B26D 2210/02* (2013.01)

(58) Field of Classification Search

CPC ... B26D 3/18; B26D 3/22; B26D 7/18; B26D 7/1818; B26D 2007/1809; B26D 9/00; B26D 7/0691; B26D 3/225; B26D 2210/02; B26D 1/20; B26D 1/205; B26D 1/38; B26D 7/1845; Y10T 83/6473; Y10T 83/0524; Y10T 83/2096; Y10T 83/21; Y10T 83/2105; Y10T 83/2107; Y10T 83/2118; Y10T 83/212; Y10T 83/6491

USPC ..... 241/243, 73

See application file for complete search history.

(56) References Cited

U.S. PATENT DOCUMENTS

| | | | | |
|---|---|---|---|---|
| 2,297,604 | A * | 9/1942 | Bateman | F25C 5/046 241/221 |
| 2,436,410 | A * | 2/1948 | Urschel | B26D 3/18 83/403 |
| 4,625,606 | A | 12/1986 | Pinegar et al. | |
| 4,743,307 | A | 5/1988 | Mason | |
| 4,782,729 | A | 11/1988 | Mathot | |
| 4,906,145 | A | 3/1990 | Oliver | |
| 5,129,299 | A | 7/1992 | Fischer et al. | |
| 5,249,494 | A | 10/1993 | Borvitz | |

(Continued)

FOREIGN PATENT DOCUMENTS

| | | |
|---|---|---|
| JP | 2004-321744 | 11/2004 |
| JP | 2008-178962 | 8/2008 |

(Continued)

*Primary Examiner* — Evan H MacFarlane

(74) *Attorney, Agent, or Firm* — Hartman Global IP Law; Gary M. Hartman; Domenica N.S. Hartman

(57) ABSTRACT

Machines and methods capable of producing diced products from a variety of materials. A stripper plate for such machines and methods has one or more slots sized to accommodate one or more circular knives of a circular cutter. The stripper plate has a base and an oppositely-disposed second surface. The slots are defined in the second surface and extend from the second surface to the base so as to define individual openings in the base. The slots are defined by multi-tiered walls so that the slots are wider at the openings thereof than in another portion of the slots.

17 Claims, 6 Drawing Sheets

(56) References Cited

U.S. PATENT DOCUMENTS

| | | | | |
|---|---|---|---|---|
| 5,425,307 | A | 6/1995 | Rush et al. | |
| 5,722,143 | A | 3/1998 | Bucks et al. | |
| 6,536,691 | B2 | 3/2003 | Prewitt et al. | |
| 2008/0028906 | A1* | 2/2008 | Reddell ..... | B26D 1/24 83/122 |

FOREIGN PATENT DOCUMENTS

| | | |
|---|---|---|
| JP | 2008-283907 | 11/2008 |
| KR | 10-2004-0083560 | 10/2004 |

* cited by examiner

STRIPPER PLATES, DICING MACHINES THAT UTILIZE STRIPPER PLATES, AND METHODS OF USE

BACKGROUND OF THE INVENTION

The present invention generally relates to methods and machines for cutting solid and semisolid materials, including food products.

The AFFINITY® dicer is a machine manufactured by Urschel Laboratories, Inc., and is particularly well suited for dicing various materials, notable but nonlimiting examples of which include cheeses and meats. The AFFINITY® dicer is well known as capable of high capacity output and precision cuts. In addition, the AFFINITY® dicer has a sanitary design to deter bacterial growth.

A nonlimiting representation of an AFFINITY® dicer is shown in FIG. 1. Product is delivered to the dicer, for example, through a feed hopper (not shown), and enters a rotating impeller 10, where centrifugal forces hold the product against an inner wall of a stationary case 12 equipped with a slicing knife 14. The slicing knife 14 is disposed in an opening in the case 12 and typically oriented approximately parallel to the generally horizontal rotational axis of the impeller 10. Paddles of the impeller 10 carry the product to the slicing knife 14, producing slices that enter a dicing unit 35 (FIG. 3) of the machine. As used herein, the dicing unit 35 comprises a part of the machine downstream of the knife 14 and generally includes a feed drum 16, feed roll 18, circular cutter 20, and cross-cutter 22, each of which individually rotates about its respective axis of rotation. FIG. 2 represents an exploded view of the dicing unit 35 of FIG. 1, and FIG. 3 represents a side view of the feed drum 16, feed roll 18, circular cutter 20, and cross-cutter 22, essentially in a direction parallel to their axes of rotation. Within the dicing unit 35, slices pass between the rotating feed drum 16 and feed roll 18, then enter the rotating circular cutter 20 whose axis of rotation is approximately parallel to the rotational axes of the impeller 10, rotating feed drum 16, and feed roll 18. The circular cutter 20 is equipped with disk-shaped knives (30 in FIGS. 2 and 3), each oriented approximately perpendicular to the rotational axis of the circular cutter 20 and, therefore, such that the knives 30 cut each slice into multiple parallel strips. The strips pass directly into the rotating cross-cutter 22 whose axis of rotation is also approximately parallel to the rotational axis of the circular cutter 20. The cross-cutter 22 is equipped with rectilinear knives (31 in FIG. 2), each oriented approximately parallel to the rotational axes of the cross-cutter 22, and therefore transverse and preferably perpendicular to the knives 30 of the circular cutter 20, to produce final cross-cuts that yield a diced product. The rotational speed of the cross-cutter 22 is preferably independently controllable relative to the feed drum 16, feed roll 18, and circular cutter 20 so that the size of the diced product can be selected and controlled. As evident from FIG. 1, the rotational axes of the impeller 10, feed drum 16, feed roll 18, circular cutter 20, and cross-cutter 22 are all approximately horizontal and parallel to each other.

As represented in FIG. 2, each of the feed drum 16, feed roll 18, circular cutter 20, and cross-cutter 22 is configured to be individually coaxially mounted on a separate shaft or spindle. In the nonlimiting representation of FIG. 2, the feed drum 16 and cross-cutter 22 are shown as being individually mounted on separate spindle shafts 38 and secured thereto with a retaining washer 40 and nut 42, and the feed roll 18 and circular cutter 20 are shown as being individually mounted on separate spindle shafts 44 and secured thereto with bolts 45. The feed drum 16, feed roll 18, circular cutter 20, and cross-cutter 22 are all shown as being cantilevered from a support structure 50 of the machine, for example, an enclosure, frame and/or other structures interconnected with the stationary case 12 and including drive systems operable to rotate the impeller 10, feed drum 16, feed roll 18, circular cutter 20, and cross-cutter 22 at the desired rotational speeds thereof.

FIGS. 2 and 3 further represent a shear or stripper plate 32 supported and secured with bolts 36 to a support bar 34, which is represented in FIG. 2 as being cantilevered from the support structure 50, similar to the feed drum 16, feed roll 18, circular cutter 20, and cross-cutter 22. FIGS. 4 and 5 represent isolated perspective and cross-sectional views, respectively, of the stripper plate 32. The stripper plate 32 has an upper shear edge 47 adapted to strip products (strips) from the circular cutter 20 prior to being diced with the cross-cutter 22. Slots 46 (FIGS. 2, 4 and 5) are defined in the stripper plate 32 facing the circular cutter 20, and the knives 30 of the circular cutter 20 are partially received in the slots 46, as represented in FIG. 3. As evident from FIGS. 3, 4, and 5, the slots 46 extend to the shear edge 47, such that individual edges of the shear edge 47 between adjacent slots 46 protrude between adjacent knives 30 of the circular cutter 20 to remove strips from therebetween. A lower shear edge 48 of the stripper plate 32 is in close proximity to the knives 31 of the cross-cutter 22 to ensure complete dicing of the strips delivered from the circular cutter 20 to the cross-cutter 22. The slots 46 also extend through the thickness of the plate 32 to the base of the plate 32, such that an opening 52 is defined at the lower extent of each slot 46, as depicted in FIGS. 4 and 5. The width of the slots 46 is sufficient to accommodate the axial thickness of the knife 30 received therein and provide a clearance therebetween. The slots 46 also define parallel walls 54 (of which one is visible in FIG. 5) that separate adjacent knives 30 from each other in the vicinity of the opening 52 at the base of the plate 32. Each wall 54 defines one of the individual edges of the shear edge 47.

While completely well suited for many food processing applications, including cheeses for which the AFFINITY® dicer is widely used, there is an ongoing desire for greater productivity in machines of this type.

BRIEF DESCRIPTION OF THE INVENTION

The present invention provides machines and methods capable of producing diced products from a variety of materials.

According to one aspect of the invention, a stripper plate is provided that has one or more slots sized to accommodate one or more circular knives of a circular cutter. The stripper plate has a base and an oppositely-disposed second surface. The slots are defined in the second surface and extend from the second surface to the base so as to define individual openings in the base. The slots are defined by multi-tiered walls so that the slots are wider at the openings thereof than in another portion of the slots.

According to another aspect of the invention, a dicing machine is provided that includes a knife adapted to slice food product to produce slices, a circular cutter comprising knives that are adapted and arranged to receive the slices from the knife and cut the slices into strips, a cross-cutter comprising knives that are adapted and arranged to receive the strips from the circular cutter and produce a cross-cut in the strips, and a stripper plate that is at least partially between the circular cutter and the cross-cutter. The stripper plate defines a first shear edge in proximity to the knives of the cross-cutter and adapted to ensure dicing of the strips received by the cross-cutter from the circular cutter. The stripper plate further defines a second shear edge in proximity to the knives of the circular cutter and adapted to remove slices from between the knives of the circular cutter. The stripper plate also has a base at which the first shear edge is defined, an oppositely-disposed second surface at which the second shear edge is defined, and slots that receive the knives of the circular cutter. The slots extend from the second surface to the base so as to define individual openings in the base, and the slots are defined by multi-tiered walls so that the slots are wider at the openings thereof than at least one region within the slots.

Other aspects of the invention include methods of using machines and stripper plates of the types described above. As an example, a method of using a machine as described above may entail rotating the circular cutter to cut a food product into slices, and rotating the cross-cutter to dice the slices. Fragments of the food product are more likely to fall out of the slots through the openings in the base of the stripper plate, and therefore are less likely to accumulate within the slots or within the openings.

A technical effect of the invention is the ability to reduce buildup of product fragments and fines between the circular cutter, cross-cutter, and stripper plate of a dicing unit, thereby increasing the intervals at which the machine would otherwise need to be shut down to permit cleaning of the dicing unit.

Other aspects and advantages of this invention will be better appreciated from the following detailed description.

DETAILED DESCRIPTION OF THE INVENTION

Figure 1:
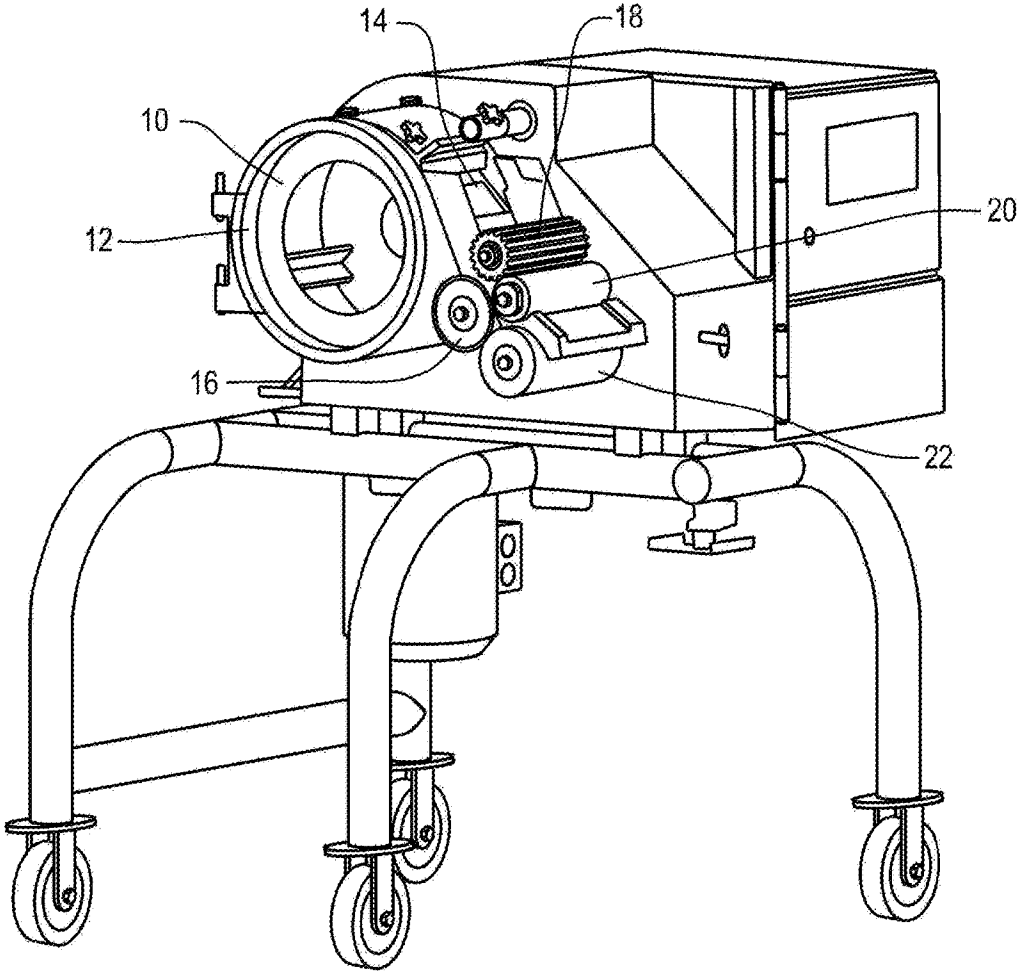
FIG. 1 (Prior Art)
FIG. 1 schematically represents an example of an AFFINITY® dicer machine.
Figure 2:
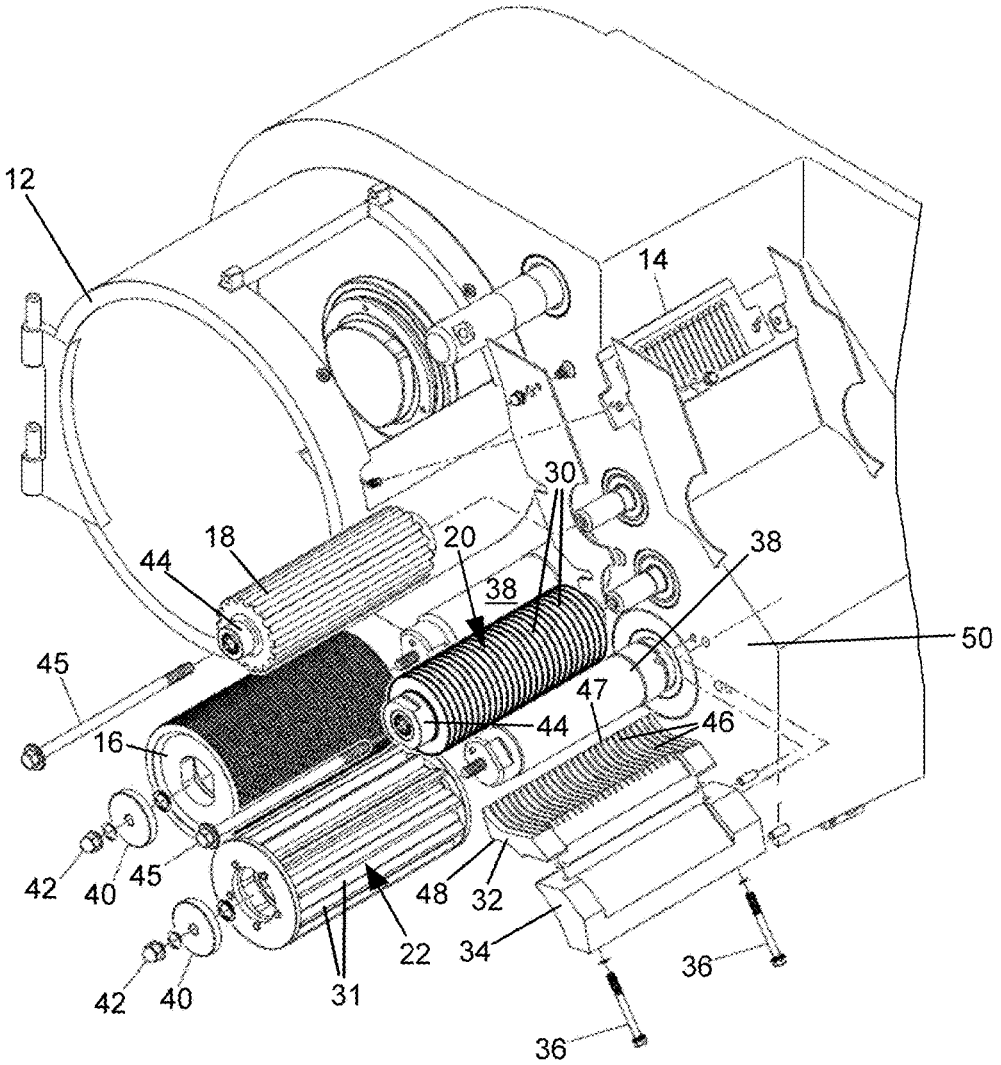
FIG. 2 (Prior Art)
FIG. 2 represents a fragmentary exploded view of a dicing unit of the AFFINITY® dicer machine of FIG. 1.
Figure 3:
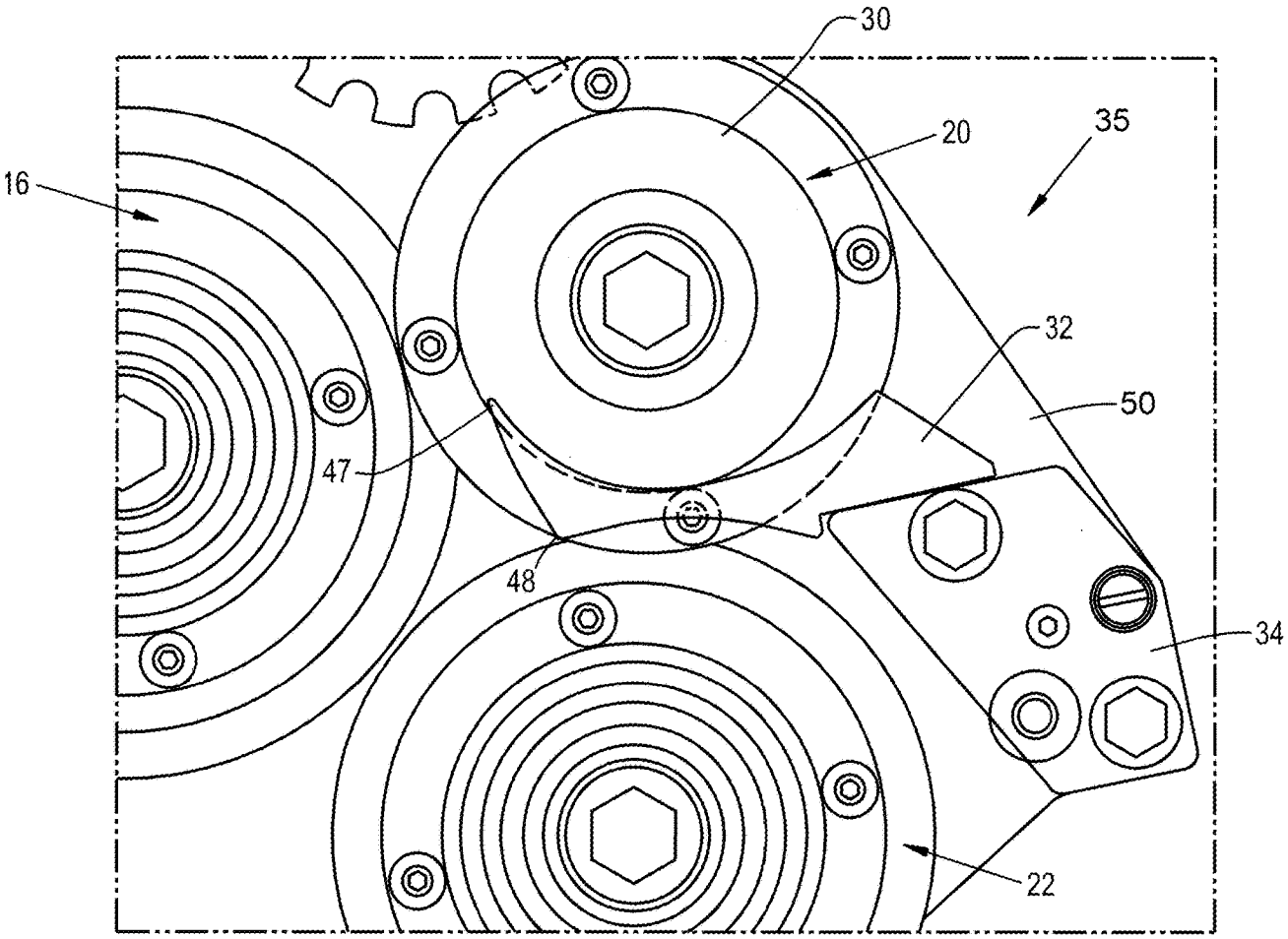
FIG. 3 (Prior Art)
FIG. 3 is an end view of a dicing unit of the type represented in FIGS. 1 and 2.

FIGS. 6 through 9 depict various views of a stripper plate 132 configured as a component of a dicing unit adapted to be installed on a dicing machine, as a nonlimiting example, the AFFINITY® dicer and dicing unit represented in FIGS. 1 through 3. The dicing unit is adapted to cut a sliced product in a direction transverse to the cut that produced the sliced product (a "cross-cut") to achieve a dicing effect and produce a diced product. However, those skilled in the art will appreciate that the dicing unit and its benefits are not limited to such uses, nor limited to the AFFINITY® dicer.

Similar to the stripper plate 32 of FIGS. 2 through 5, the stripper plate 132 represented in FIGS. 6 through 9 is configured for mounting to a support bar (such as the support bar 34 of FIGS. 2 and 3), and to interact with a circular cutter (such as the cutter 20 of FIGS. 2 and 3). The term "stripper plate" will be used in reference to the stripper plate 132 represented in FIGS. 6 through 9, though it should be understood that this term encompasses other means capable of the function of the stripper plate 132, for example, means capable of stripping products (strips) from a cutting device. Furthermore, in the nonlimiting embodiment represented in FIGS. 6 through 9, the stripper plate 132 is configured to permit its use as part of a retrofit unit for the AFFINITY® dicer of FIGS. 1 through 3, in that the stripper plate 132 can be substituted for the stripper plate 32 shown in FIGS. 2 through 5. However, it should be appreciated that the stripper plate 132 can also be provided as original equipment on a dicing machine. Because of the similarities between the stripper plate 132 of FIGS. 6 through 9 and the stripper plate 32 of FIGS. 2 through 5, the following discussion of FIGS. 6 through 9 will focus primarily on aspects of the stripper plate 132 of FIGS. 6 through 9 that differ from the stripper plate 32 of FIGS. 2 through 5 in some notable or significant manner. Other aspects of the stripper plate 132 of FIGS. 6 through 9 not discussed in any detail can be, in terms of structure, function, materials, etc., essentially as was described for the stripper plate 32 of FIGS. 2 through 5.

Figure 6:
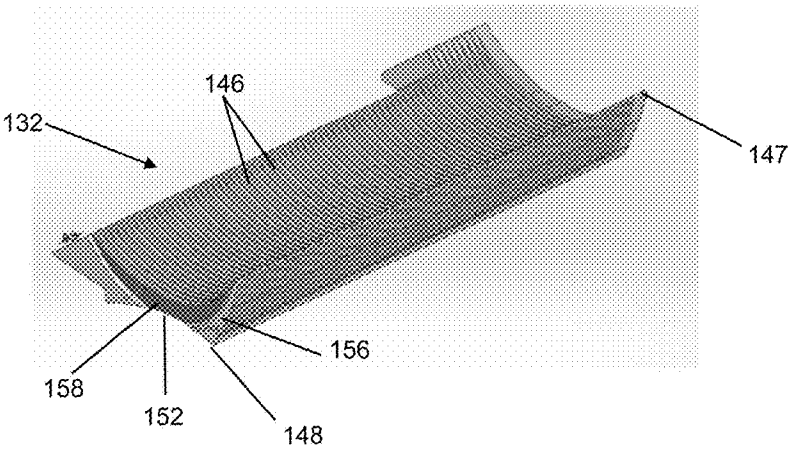
FIGS. 6 and 7 represent perspective and cross-sectional views, respectively, of a stripper plate suitable for use in dicing units of the type represented in FIGS. 1, 2 and 3, in accordance with a nonlimiting embodiment of the invention.
Figure 7:
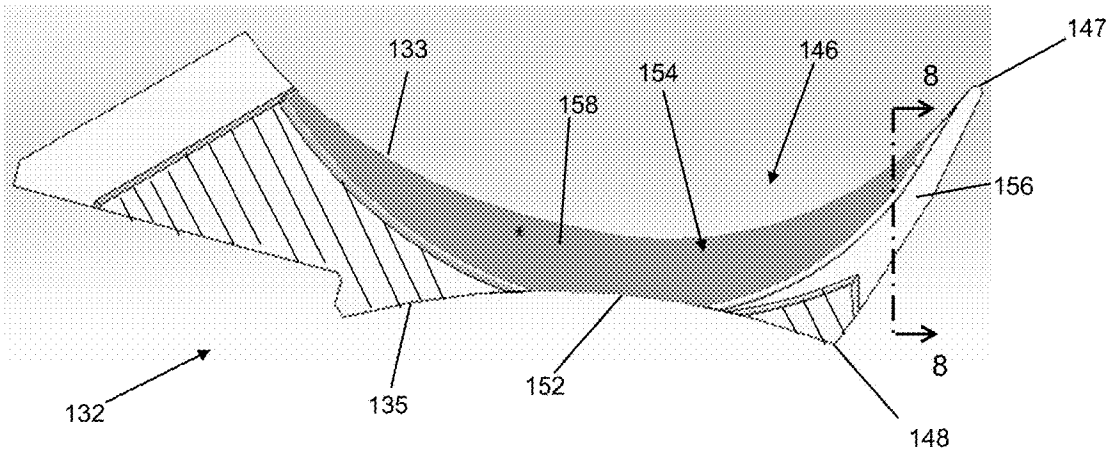
Figure 9:
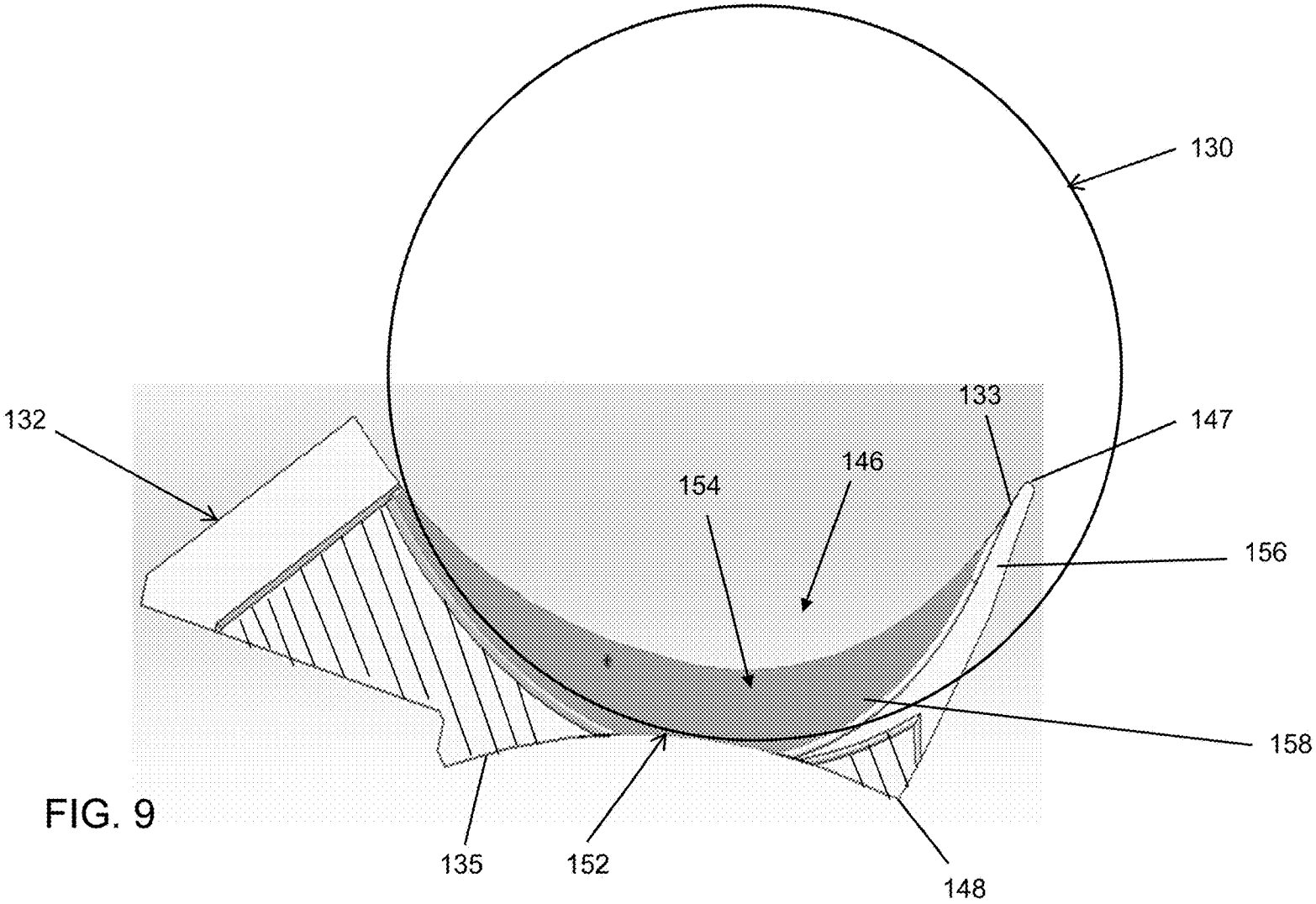
FIG. 9 schematically represents a cross-sectional view showing a disk-shaped cutting knife superimposed on the stripper plate of FIGS. 6 and 7.

FIGS. 6 and 7 represent isolated perspective and cross-sectional views, respectively, of the stripper plate 132, and FIG. 9 schematically represents a cross-sectional view similar to FIG. 7 but showing a disk-shaped cutting knife 130 of a circular cutter (e.g., 20 in FIGS. 2 and 3) superimposed on the stripper plate 132. The stripper plate 132 has an upper shear edge 147 adapted to strip products (strips) from the circular cutter prior to being diced with a cross-cutter (e.g., 22 in FIGS. 2 and 3). Slots 146 are defined in an upper surface 133 of the stripper plate 132 facing the circular cutter, and FIG. 9 schematically represents the knife 130 of the circular cutter as partially received in one of the slots 146. As evident from FIGS. 6, 7 and 9, the slots 146 extend to the shear edge 147, such that individual edges of the shear edge 147 between adjacent slots 146 protrude between adjacent knives 130 of the circular cutter to remove strips from therebetween. A lower shear edge 148 of the stripper plate 132 is adapted to be located in close proximity to the knives of the cross-cutter to ensure complete dicing of strips delivered from the circular cutter to the cross-cutter. The slots 146 are continuous through the thickness of the plate 132, such that an opening 152 is defined at the lower extent of each slot 146, as depicted in FIGS. 6, 7 and 9, and the lower edge of each knife 130 of the circular cutter is in proximity to one of these openings 152 at the base 135 of the stripper plate 132 as evident from FIG. 9.

Figure 8:
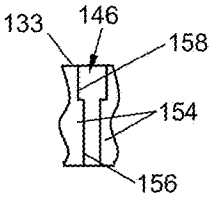
FIG. 8 is a cross-sectional view taken along section line 8-8 in FIG. 7.

Each slot 146 is defined by a pair of walls 154 that face each other. One such wall 154 is visible in FIGS. 7 and 9, whereas FIG. 8 shows a pair of walls 154 separated by a slot 146. As used herein, the width of a slot 146 refers to the distance between the walls 154 that form the slot 146. When assembled with a circular cutter (for example, as shown in FIGS. 2 and 3), each knife 130 is received in one of the slots 146 and each adjacent pair of knives 130 is separated by a wall 154. Each wall 154 also defines one of the individual edges of the shear edge 147.

Figure 4:
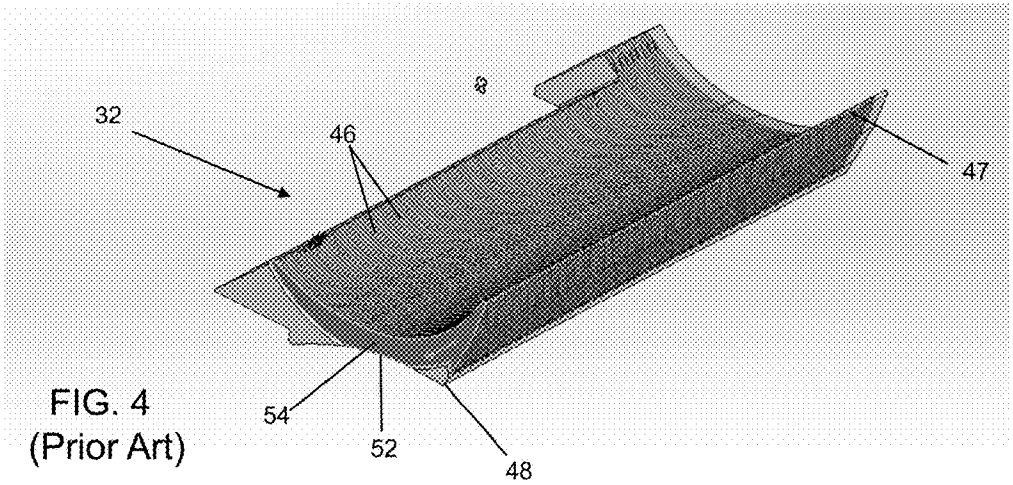
FIG. 4 (Prior Art)
FIGS. 4 and 5 represent perspective and cross-sectional views, respectively, of a stripper plate represented in FIGS. 1, 2 and 3.
Figure 5:
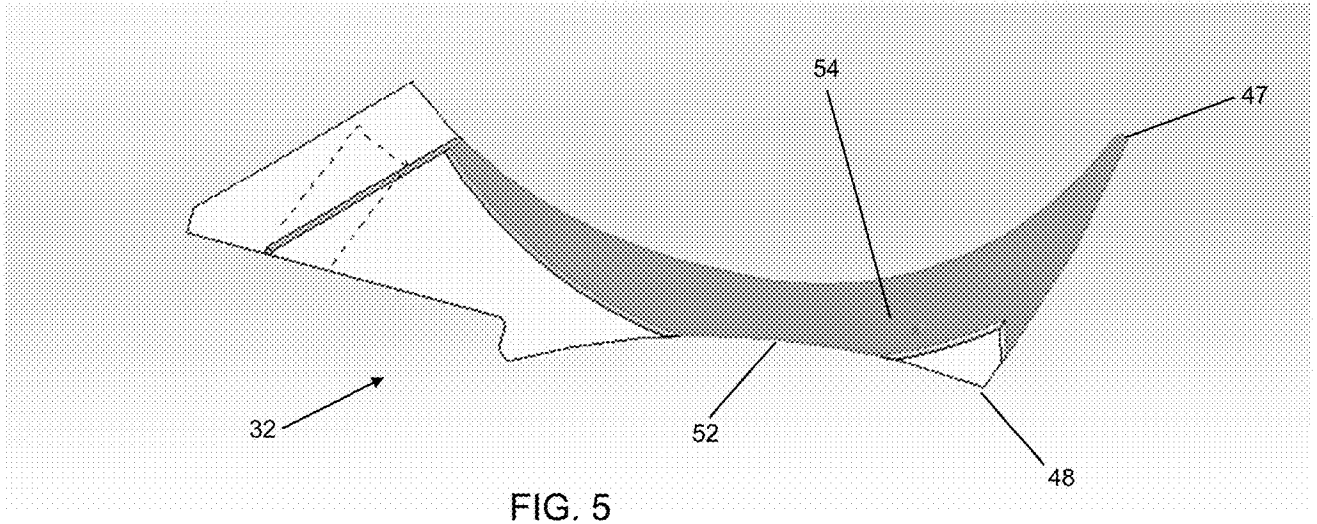
FIG. 5 (Prior Art)

The walls 154 seen in FIGS. 6 through 9 are not entirely planar, in contrast to the walls 54 of the stripper plate 32 represented in FIGS. 4 and 5. Instead, the walls 154 are represented as having multi-tiered surfaces, represented in the nonlimiting embodiment of FIGS. 6 through 9 as two-tiered surfaces. A first of the tiers 156 is planar and lies within a portion of each wall 154 between the shear edges 147 and 148. The remainder of the surface of each wall 154 is shown defined by a second tier 158, which is also planar and lies within a portion of the wall 154 that includes an edge that the wall 154 defines with the upper surface 133 of the stripper plate 132. In addition, the second tier 158 borders the entirety of the opening 152 at the base 135 of the plate 132. As shown in FIG. 8, the second tiers 158 are recessed into their respective walls 154 relative to the first tiers 156. In this manner, the width of a slot 146 defined by a pair of facing walls 154 is greater within the region of the slot 146 defined by the second tiers 158, as evident from FIG. 8. The width of the slot 146 at the edge between the shear edges 147 and 148 is sufficient to accommodate the axial thickness of the knife 130 and provide an acceptable clearance therebetween. Because the second tiers 158 of the walls 154 extend to the opening 152 of their corresponding slot 146, the slots 146 are wider at their openings 152 than between the shear edges 147 and 148. Though FIG. 8 shows both walls 154 as being tiered, it is within the scope of the invention that only one wall 154 of each slot 146 is tiered while still yielding a slot 146 that is wider at its opening 152 than at its shear edge 147. Though not required, the slot 146 shown in FIG. 8 has uniform and constant widths in its regions defined by the tiers 156 and 158. In FIGS. 7 and 9, such a condition would result in a slot 146 having a uniform and constant width in the shaded region between the upper surface 133 and base 135 of the plate 132, and a uniform and constant but narrower width in the unshaded region of FIGS. 7 and 9 between the shear edges 147 and 148. It is also foreseeable that the walls 154 (including either or both tiers 156 and 158 of each wall 154) could be tapered in either or both regions depicted in FIGS. 7 and 9 so that the width of the slot 146 becomes gradually wider or narrower in the direction toward the base 135 of the plate 132.

An advantage of the configuration of the stripper plate 132 represented in FIGS. 6 through 9 arises when slicing and dicing solid or semisolid products, and whose fines or fragments tend to adhere or otherwise collect within the individual openings 52 at the base of the stripper plate 32 of FIGS. 2 through 5. As a nonlimiting example, when dicing cheese, the walls that define the slots 46 of the stripper plate 32 tend to collect cheese fines. Rubbing contact between the collected cheese fines and the knives 30 of the circular cutter 20 as the cutter 20 rotates can cause the cheese fines to burn, which eventually necessitates stoppage and cleaning of the dicing machine. By fabricating the stripper plate 132 to have slots 146 defined by multi-tiered walls 154, the openings 152 are capable of being significantly wider than the openings 52 of the stripper plate 32 of FIGS. 2 through 5, promoting the ability of the cheese fines to fall through the openings 152 instead of collecting within the slots 146 and their openings 152.

While the invention has been described in terms of a specific embodiment, it is apparent that other forms could be adopted by one skilled in the art. For example, the physical configurations of the dicing machine, dicing unit, stripper plate 132, etc., could differ from those shown, and various materials and processes could be used in their manufacture. Therefore, the scope of the invention is to be limited only by the following claims.

The invention claimed is:

1. A dicing machine comprising a stripper plate, a circular cutter comprising rotating circular knives adapted and arranged to cut a product into strips, and a cross-cutter comprising knives that are adapted and arranged to receive the strips from the circular cutter and produce a cross-cut in the strips, the stripper plate being at least partially between the circular cutter and the cross-cutter and having slots sized to accommodate the circular knives, the stripper plate having a base and an oppositely-disposed second surface above the base, the slots being defined in the second surface and extending downward from the second surface to the base so as to define individual openings in the base at a lower extent of each slot, the slots being defined by multi-tiered walls disposed between the base and the second surface, each of the slots being formed by a facing pair of inner surfaces of the multi-tiered walls so as to have a width as measured in a direction normal to the facing pair of the inner surfaces of the multi-tiered walls and so that the slots are wider at the openings of the slots at the base than at least one region within the slots as measured in the direction normal to the facing pairs of the inner surfaces of the multi-tiered walls, the circular knives of the circular cutter being partially received in the slots and extending downward through the slots from the second surface to the base so that lower edges of the circular knives are in proximity to the openings of the slots in the base.

2. The dicing machine of claim 1, wherein the second surface defines a shear edge and the slots are wider at the openings of the slots at the base than at the shear edge.

3. The dicing machine of claim 2, wherein the widths of the slots are constant between the second surface and the openings.

4. The dicing machine of claim 1, wherein the base defines a first shear edge, the second surface defines a second shear edge, and the slots are wider at the opening of the slots at the base than between the first and second shear edges.

5. The dicing machine of claim 4, wherein the slots are wider between the second surface and the openings than between the first and second shear edges.

6. The dicing machine of claim 5, wherein the widths of the slots are constant between the second surface and the openings.

7. The dicing machine of claim 5, wherein the widths of the slots are constant between the first and second shear edges.

8. The dicing machine of claim 4, wherein each multi-tiered wall is two-tiered so that each slot has a first constant width between the second surface and the opening of the slot and each slot has a second constant width between the first and second shear edges, and the first constant width is greater than the second constant width.

9. The dicing machine of claim 1, wherein each multi-tiered wall has a first tier so that each slot has a first constant width in a first region of the slot between the second surface and the opening of the slot and has a second constant width in a second region of the slot, and the first constant width is greater than the second constant width.

10. The dicing machine of claim 1, the dicing machine further comprising:

a slicing knife adapted to slice the product to produce slices, the circular knives of the circular cutter being adapted and arranged to receive the slices from the slicing knife and cut the slices into strips;

wherein the stripper plate defines a first shear edge in proximity to the knives of the cross-cutter and adapted to ensure dicing of the strips received by the cross-cutter from the circular cutter, the stripper plate defines a second shear edge in proximity to the circular knives of the circular cutter and adapted to remove slices from between the circular knives of the circular cutter.

11. A dicing machine comprising:

a slicing knife adapted to slice food product to produce slices;

a circular cutter comprising rotating circular knives that are adapted and arranged to receive the slices from the slicing knife and cut the slices into strips;

a cross-cutter comprising knives that are adapted and arranged to receive the strips from the circular cutter and produce a cross-cut in the strips;

a stripper plate that is at least partially between the circular cutter and the cross-cutter, the stripper plate defining a first shear edge in proximity to the knives of the cross-cutter and adapted to ensure dicing of the strips received by the cross-cutter from the circular cutter, the stripper plate defining a second shear edge in proximity to the circular knives of the circular cutter and adapted to remove slices from between the circular knives of the circular cutter;

wherein the stripper plate has a base at which the first shear edge is defined, an oppositely-disposed second surface above the base at which the second shear edge is defined, and slots that receive the circular knives of the circular cutter, the slots extending downward from the second surface to the base so as to define individual openings in the base at a lower extent of each slot, the slots being defined by multi-tiered walls, each of the slots being formed by a facing pair of inner surfaces of the multi-tiered walls so as to have a width as measured in a direction normal to the facing pair of the inner surfaces of the multi-tiered walls and so that the slots are wider at the openings of the slots than at the second shear edge in the direction normal to the facing pairs of the inner surfaces of the multi-tiered walls, the circular knives of the circular cutter being partially received in the slots and extending downward through the slots from the second surface to the base so that lower edges of the circular knives are in proximity to the openings of the slots in the base.

12. The dicing machine of claim 11, wherein the slots are wider between the second surface and the openings than between the first and second shear edges.

13. The dicing machine of claim 11, wherein the widths of the slots are constant between the second surface and the openings.

14. The dicing machine of claim 11, wherein the widths of the slots are constant between the first and second shear edges.

15. The dicing machine of claim 11, wherein each multi-tiered wall is two-tiered so that each slot has a first constant width between the second surface and the opening of the slot and each slot has a second constant width between the first and second shear edges, and the first constant width is greater than the second constant width.

16. The dicing machine of claim 11, wherein a portion of each of the circular knives of the circular cutter is disposed within a first region of the slot having the first constant width and disposed within a second region of the slot having the second constant width.

17. A method of using the machine of claim 11, the method comprising rotating the circular cutter to cut a food product into strips and rotating the cross-cutter to dice the strips, wherein fragments of the food product fall out of the slots through the openings in the base of the stripper plate.

* * * * *